US006809710B2

(12) United States Patent
Prache et al.

(10) Patent No.: US 6,809,710 B2
(45) Date of Patent: Oct. 26, 2004

(54) GRAY SCALE PIXEL DRIVER FOR ELECTRONIC DISPLAY AND METHOD OF OPERATION THEREFOR

(75) Inventors: Olivier F. Prache, Pleasantville, NY (US); Shashi D. Malaviya, Hopewell Junction, NY (US)

(73) Assignee: eMagin Corporation, Hopewell Junction, NY (US)

( * ) Notice: Subject to any disclaimer, the term of this patent is extended or adjusted under 35 U.S.C. 154(b) by 0 days.

(21) Appl. No.: 09/765,582

(22) Filed: Jan. 22, 2001

(65) Prior Publication Data

US 2001/0045929 A1 Nov. 29, 2001

Related U.S. Application Data

(60) Provisional application No. 60/177,277, filed on Jan. 21, 2000.

(51) Int. Cl.[7] ..... G09G 3/32
(52) U.S. Cl. ..... 345/82; 345/46; 315/169.1
(58) Field of Search ..... 345/42–46, 76, 345/77, 82, 83, 204, 206, 208, 212, 55; 315/160, 169.1, 169.3, 169.4

(56) References Cited

U.S. PATENT DOCUMENTS

| | | | | |
|---|---|---|---|---|
| 4,242,679 A | | 12/1980 | Morozumi et al. | |
| 4,441,106 A | | 4/1984 | Jackson | |
| 4,659,967 A | | 4/1987 | Dahl | |
| 4,866,430 A | | 9/1989 | Chek | |
| 5,408,226 A | | 4/1995 | Kwon | |
| 5,719,589 A | | 2/1998 | Norman et al. | |
| 5,723,950 A | | 3/1998 | Wei et al. | |
| 5,781,169 A | | 7/1998 | Kuijik et al. | |
| 5,786,796 A | * | 7/1998 | Takayama et al. | 345/76 |
| 5,903,246 A | | 5/1999 | Dingwall | |
| 5,952,789 A | * | 9/1999 | Stewart et al. | 315/169.4 |
| 6,100,860 A | * | 8/2000 | Takayama et al. | 345/76 |
| 6,157,356 A | * | 12/2000 | Troutman | 345/82 |
| 6,191,534 B1 | | 2/2001 | Schuler et al. | |
| 6,229,506 B1 | * | 5/2001 | Dawson et al. | 345/82 |
| 6,278,242 B1 | * | 8/2001 | Cok et al. | 315/169.1 |
| 6,384,804 B1 | * | 5/2002 | Dodabalapur et al. | 345/82 |

* cited by examiner

*Primary Examiner*—Regina Liang
*Assistant Examiner*—Jennifer T. Nguyen
(74) *Attorney, Agent, or Firm*—Epstein Drangel Bazerman & James, LLP; Joseph F. Murphy

(57) ABSTRACT

A circuit is disclosed for driving an OLED in a graphics display. The circuit employs a current source operating in a switched mode. The output of the current source is connected to a terminal of the OLED. The current source is responsive to a combination of a selectively set cyclical voltage signal and a cyclical variable amplitude voltage signal. The current source, when switched on, is designed and optimized to supply the OLED with the amount of current necessary for the OLED to achieve maximum luminance. When switched off, the current source blocks the supply of current to the OLED, providing a uniform black level for an OLED display. The apparent luminance of the OLED is controlled by modulating the pulse width of the current supplied to the OLED, thus varying the length of time during which current is supplied to the OLED. By using a switched mode of operation at the current source, the circuit of the present invention is able to employ a larger range of voltages to control the luminance values in a current-driven OLED display.

27 Claims, 4 Drawing Sheets

GRAY SCALE PIXEL DRIVER FOR ELECTRONIC DISPLAY AND METHOD OF OPERATION THEREFOR

CROSS REFERENCE TO RELATED APPLICATIONS AND ASSERTION OF SMALL ENTITY STATUS

The application relates to and claims priority on U.S. Provisional Patent Application Ser. No. 60/177,277, filed on Jan. 21, 2000, entitled "Gray Scale Pixel Driver for Electronic Display and Method of Operation Thereof." Applicant hereby asserts that it is a small entity as described under 37 CFR § 1.27 and is therefore entitled to a reduction in fees associated with the filing of this application.

FIELD OF THE INVENTION

The invention relates to electrical circuits for driving individual picture elements of an electronic display, particularly, an Organic Light Emitting Device (OLED) display.

BACKGROUND OF THE INVENTION

Organic light emitting devices have been known for approximately two decades. OLEDs work on certain general principles. An OLED is typically a laminate formed on a substrate such as soda-lime glass or silicon. A light-emitting layer of a luminescent organic solid, as well as adjacent semiconductor layers, are sandwiched between a cathode and an anode. The light-emitting layer may be selected from any of a multitude of luminescent organic solids, and may consist of multiple sublayers or a single blended layer of such material. The cathode may be constructed of a low work function material while the anode may be constructed from a high work function material. Either the OLED anode or the cathode (or both) should be transparent in order to allow the emitted light to pass through to the viewer. The semiconductor layers may include hole-injecting or electron-injecting layers.

When a potential difference is applied across the device (from cathode to anode), negatively charged electrons move from the cathode to the electron-injecting layer and finally into the layer(s) of organic material. At the same time positive charges, typically referred to as holes, move from the anode to the hole-injecting layer and finally into the same organic light-emitting layer(s). When the positive and negative charges meet in the organic material, they produce photons.

The wave length—and consequently the color—of the photons depends on the material properties of the organic material in which the photons are generated. The color of light emitted from the OLED can be controlled by the selection of the organic material, or by the selection of dopants, or by other techniques known in the art. Different colored light may be generated by mixing the emitted light from different OLEDs. For example, white light may be produced by mixing the light from blue, red, and yellow OLEDs simultaneously.

In a matrix-addressed OLED device, numerous individual OLEDs may be formed on a single substrate and arranged in groups in a grid pattern. Several OLED groups forming a column of the grid may share a common cathode, or cathode line. Several OLED groups forming a row of the grid may share a common anode, or anode line. The individual OLEDs in a given group emit light when their cathode line and anode line are activated at the same time. A group of OLEDs within the matrix may form one pixel in a display, with each OLED usually serving as one subpixel or pixel cell.

OLEDs have a number of beneficial characteristics. These include: a low activation voltage (about 5 volts); fast response when formed with a thin light-emitting layer; high brightness in proportion to the injected electric current; high visibility due to self-emission; superior impact resistance; and ease of handling. OLEDs have practical application in television, graphic display systems, and digital printing. Although substantial progress has been made in the development of OLEDs to date, additional challenges remain.

For example, OLED brightness may be controlled by adjusting the current or voltage supplied to the anode and cathode. Light output for an OLED driven by current, however, may be more stable than for a voltage driven OLED, and thus, current driven devices are preferred. For applications such as microdisplays where the pixel size can be very small (a few microns on the side), the resulting current requirement may be very small, typically a few nanoamperes.

The requirement for small driving currents is further complicated by the need for gray scale control. The relative amount of light generated by an OLED is commonly referred to as the "gray scale" or "gray level." Acceptable gray scale response (as seen by the human eye) requires a constant ratio between adjacent gray levels. In a current driven device, gray scale control is achieved by controlling the amount of current applied to the OLED. Application of the power law shows that very small driving currents are required in order to obtain the darker levels of the gray scale. Accomplishing gray scale control in microdisplays, such as those referenced above, may be particularly difficult due to the inherently small driving currents called for in microdisplays in the first instance. In some cases the required currents may be as low as a tens of pico-amperes, depending on the organic material luminous efficiency and the pixel size. Such current levels are on the same level as the leakage currents encountered in conventional cmos processes. It is therefore extremely difficult, if not impractical, to successfully control gray scale in microdisplays by varying current magnitude.

The challenge is further compounded by two major factors: Transistor transconductance function and transistor to transistor variability over the IC area.

An additional challenge is presented by active matrix OLEDs that are addressed on a row-by-row basis. It is important in row addressed OLEDs that the correct driving signal reach the destination pixel no matter where the pixel is located (i.e. without regard to whether the pixel is located at the beginning or the end of the row being addressed). Thus, settling time may be an issue. The preferred method of transporting a driving signal with a reduced settling time impact is to use a voltage source with a low output impedance. Since the OLED requires current, the voltage must be transformed into a current. A mos transistor may be used to achieve this transformation. The mos transistor may be tied to a capacitor used to store the voltage used in the transformation. The voltage to current transfer function for the transistor is proportional to the square of the gate-source voltage. Accordingly, as the current required to achieve particular levels of gray scale decreases, the voltage stored on the capacitor tied to the gate electrode decreases even more rapidly. This relationship makes it increasingly difficult to generate the small voltages required for the lower gray scale levels. Furthermore, the voltage-current transformation relationship makes it difficult to convey the correct driving signal without it being derogated by ambient noise. Still further, the need for low level currents translates into a need for longer channel lengths for the current source transistor, which may place a constraint on pixel size.

The production of OLEDs heavily involves semiconductor processing. Semiconductor processes inherently produce some non-uniformities in the OLEDs produced. These non-uniformities may produce threshold voltage variations in the finished device. Because the operation of a current driven OLED leads to the current source transistor operating near its threshold voltage, such variations can have an adverse effect on display uniformity. This situation may worsen as the current requirement is decreased, such that the non-uniformity effect dominates (and thus degrades) the gray scale performance of the display.

References that illustrate the difficulty of addressing the aforementioned challenges include a U.S. patent issued to Ching Tang of the Eastman Kodak Corporation that describes a two transistor and storage capacitor structure. The structure described in Tang has exhibits the problems mentioned above. Another relevant reference that is illustrative of the aforementioned challenges is a U.S. patent issued to Dawson et al. of Sarnoff Research Laboratories. This patent is aimed at solving the threshold voltage variation encountered with poly-crystalline silicon processes, but does not address the small current limitations nor the need for a small control voltage. Finally it requires additional devices and places a lower limit on pixel sizes.

The present innovation introduces a second control signal and changes the operation of the current source from a linear mode to a switched mode. By relying on the switched mode, the current source can be designed and optimized for the maximum current required, as opposed to needing to be able to provide all the current values needed. Use of a switched mode of operation removes or largely reduces the challenges associated with very small current values and drastically reduces the impact of leakage currents.

Furthermore, the switched mode of operation (also called pulse width modulation) allows for the use of larger voltage values at the storage element, thus improving the design margins. The larger voltage values enabled by this technique reduce the effect of threshold voltage variations, as well as the susceptibility to noise created by switching control signals.

Finally, the switched mode allows an effective turn-off of the current source and thus provides for the required uniform black level for the display.

OBJECTS OF THE INVENTION

It is an object of the present invention to provide a circuit and method for driving organic light emitting display pixels.

It is another object of the present invention to provide a current driver for a display pixel, wherein the current driver is controlled by a pulse-width modulated voltage.

It is still another object of the present invention to provide a method of driving a display pixel using a current source.

It is yet another object of the present invention to provide a circuit and method for improving gray scale control of an organic light emitting display.

It is still another object of the present invention to provide a circuit and method for improving gray scale uniformity of an organic light emitting display.

It is still yet another object of the present invention to provide a circuit and method for increasing the operational life of an organic light emitting display.

It is still a further object of the present invention to provide a circuit and method for controlling the luminance of a display without substantially affecting the contrast ratio of the display.

It is still a further object of the present invention to provide a circuit and method for reducing the impact of leakage currents experienced in driving an OLED.

It is still another object of the present invention to provide a circuit and method for driving an OLED in which the driving circuit may be designed and optimized for a maximum driving current.

It is yet another object of the present invention to provide a circuit and method for driving an OLED that reduces the effect of threshold voltage variations.

It is still yet another object of the present invention to provide a circuit and method for driving an OLED that provides a uniform display black level.

Additional objects and advantages of the invention are set forth, in part, in the description which follows and, in part, will be apparent to one of ordinary skill in the art from the description and/or from the practice of the invention.

SUMMARY OF THE INVENTION

In response to this challenge, Applicants have developed an innovative circuit for driving a light emitting diode in a display using a current supply, said circuit comprising: a first transistor having a source, a drain, and a gate; a current supply connected to the first transistor source; an anode terminal of a light emitting diode connected to the first transistor drain; and a means for applying a combination of at least two voltages to the first transistor gate so as to control the time that the current supply is connected to the light emitting diode.

Applicants have also developed a method of driving a light emitting diode in a display using a current supply, said method comprising the steps of: applying current to an OLED responsive to at least one power transistor being in a turned on state; turning on at least one access transistor responsive to a cyclical voltage; applying a DATA voltage to a node responsive to the access transistor being turned on, said node being connected to at least the access transistor, a capacitor, and the at least one power transistor; charging the capacitor responsive to the application of the DATA voltage to the node; turning off the at least one access transistor so as to discontinue charging the capacitor in response to the DATA voltage; applying a cyclical variable amplitude voltage to the capacitor; further charging the capacitor responsive to the application of the cyclical variable amplitude voltage to the capacitor; and turning the at least one power transistor off responsive to the voltage at the node so as to selectively control the current supplied to the OLED from a current source.

Applicants have also developed a method of driving a light emitting diode in a display using a current supply, said method comprising the steps of: applying current to an OLED responsive to at least one power transistor being in a turned on state; selectively turning the at least one power transistor off responsive to a power transistor gate voltage comprised of the combination of a selectively set cyclical DATA voltage and a cyclical variable amplitude RAMP voltage.

It is to be understood that both the foregoing general description and the following detailed description are exemplary and explanatory only, and are not restrictive of the invention as claimed. The accompanying drawings, which are incorporated herein by reference, and which constitute a part of this specification, illustrate certain embodiments of the invention and, together with the detailed description, serve to explain the principles of the present invention.

BRIEF DESCRIPTION OF THE DRAWINGS

The invention will now be described in conjunction with the following drawings in which like reference numerals designate like elements and wherein.

DETAILED DESCRIPTION OF THE PREFERRED EMBODIMENT

Figure 1:
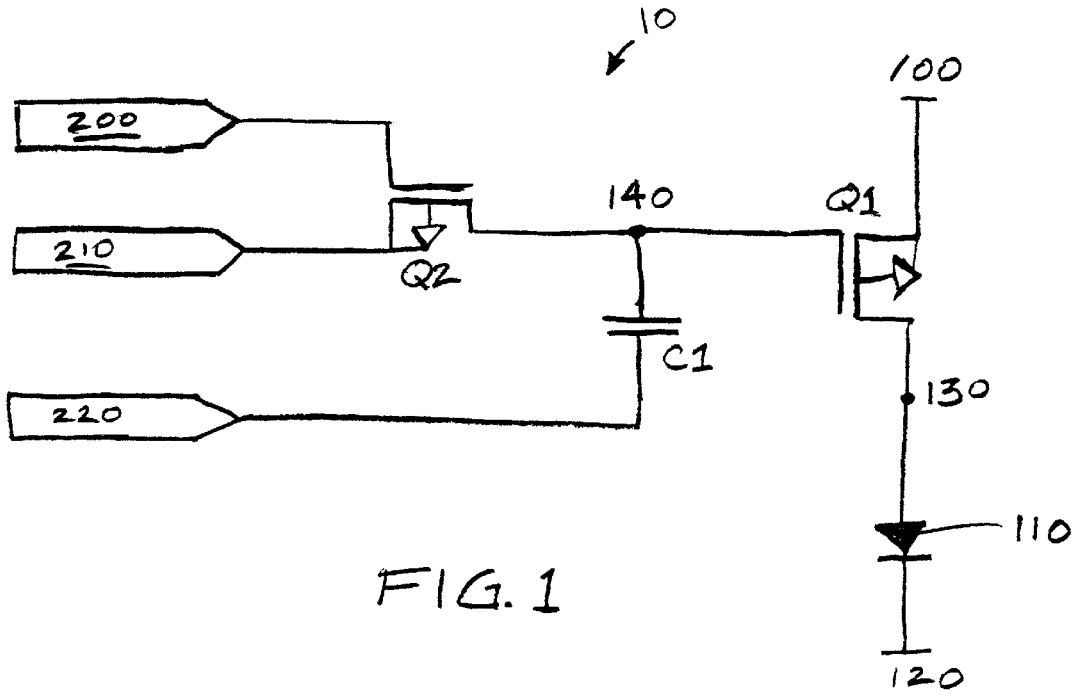
FIG. 1 is a schematic diagram of a pixel driver circuit in accordance with a first embodiment of the invention.

A first embodiment of the invention is shown schematically in FIG. 1. With reference to FIG. 1, a pixel cell driver circuit 10 of a first embodiment of the invention is shown. The driver circuit 10 may be used for an OLED display, and integrated into the OLED substrate. The driver circuit 10 may include a power terminal 100, an OLED device (such as a pixel or pixel cell) 110, a cathode terminal 120, a power transistor Q1, an access transistor Q2, a capacitor C1, a ROW input terminal 200, a DATA input terminal 210, and a RAMP voltage input 220. The driver circuit 10 is indicated to have first and second nodes, 130 and 140, which are referred to below in order to explain the variation of voltage in the circuit during its operation.

The power transistor Q1 and the access transistor Q2 are preferably p-type mos fet transistors, although other types of transistors may be used (cmos, bipolar, etc.). The transistors Q1 and Q2 each have a source, gate, and drain. The power transistor Q1 source is connected to a main power supply (not shown) through the current source terminal 100. The power transistor Q1 drain is connected to the anode terminal of the OLED device 110. The cathode of the OLED device 110 is connected to the cathode terminal 120, which may be common to a plurality of OLED devices included in the display. The access transistor Q2 drain, the capacitor C1, and the power transistor Q1 gate are all connected to the second node 140. The access transistor Q2 source is connected to the DATA input terminal 210, and the Q2 gate is connected to the ROW input terminal 200. The RAMP voltage input terminal 220 is connected to the capacitor C1.

Figure 2:
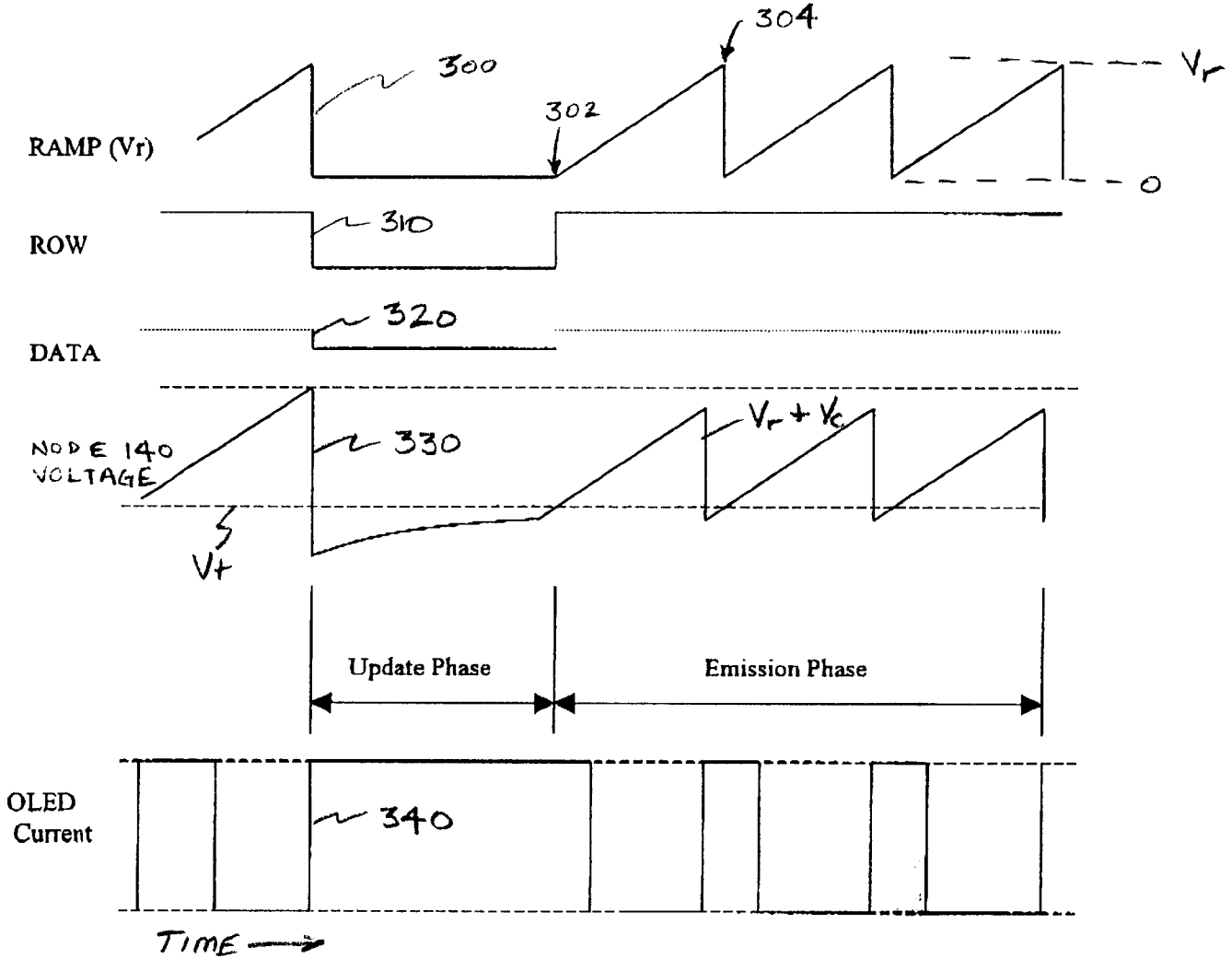
FIG. 2 is a graph of voltage and current verses times at various nodes in the circuit shown in FIG. 1.

An example of the RAMP voltage applied to the terminal 220 over time is shown as signal 300 in FIG. 2. The RAMP voltage cyclically ramps up from a starting voltage 302 of zero volts to an ending voltage 304 or Vr. The RAMP voltage is shown to increase in a positive linear fashion in FIG. 2, however, it is contemplated that non-linear RAMP voltages may be used in alternative embodiments of the invention. The RAMP voltage may be common to all pixels in the display. A switch external to the pixel array may determine the value of the RAMP voltage (ground or variable) depending on whether the pixel is being updated or not. One embodiment of the invention uses the ROW voltage to control this external switch.

The operation of the driver circuit 10 is divided into three phases: an update phase, an emission phase, and a reverse mode phase. During the update phase, the access transistor Q2 is turned on responsive to a cyclical ROW voltage applied to the ROW input terminal 200. As a result of the access transistor Q2 being turned on, the voltage at the second node 140 is updated with a DATA voltage applied to the DATA input terminal 210. As shown in FIG. 2, the RAMP voltage applied to the RAMP voltage input terminal 220 is at ground potential in order to provide a stable reference for the capacitor C1 during the update phase. An example of the ROW voltage 310, the DATA voltage 320, the voltage 330 at the second node 140, and the OLED current 340 over time are also shown in FIG. 2.

The emission phase occurs after the update phase. During the emission phase, the voltage level at the cathode terminal 120 is negatively biased with respect to ground. The access transistor Q2 is turned off (ROW voltage is at the level of the power source terminal 100). The RAMP voltage input terminal 220 is provided with a variable amplitude voltage signal 300 (FIG. 2) that adds to the voltage that was applied to the capacitor C1 during the update phase. The RAMP voltage is a periodic signal that has a period equal to the display row refresh period. In a scanned display this period is typically referred to as the horizontal period or line time.

The variation of the voltage at the second node 140 turns the power transistor Q1 on and off. As long as the voltage at the second node 140 is below the threshold voltage Vt of the power transistor Q1, the power transistor is on and current is applied to the OLED device via the first node 130. The voltage at the first node 130 (i.e. the OLED anode) is dictated by the current flowing through the OLED device. The power transistor Q1 may be designed such that when it is on, the maximum current it can provide corresponds to the current required for maximum luminance of the OLED device.

In the embodiment of the invention illustrated by FIG. 2, the voltage stored at the capacitor C1 during the update phase is Vc, and accordingly, the voltage at the second node 140 is Vr+Vc. When the voltage at the second node 140 exceeds the threshold voltage Vt of the power transistor Q1, the power transistor turns off and no current flows through the first node 130 to the OLED device.

The reverse mode phase occurs on a periodic basis, typically but not limited to, the display frame rate. During this phase, the voltage level at the cathode terminal 120 is reversed to have a positive bias with respect to ground so that the OLED device 110 is in a reverse biased condition. During this phase, there is no light emission from the OLED device. The reverse mode phase, while preferable for the long lasting operation of the OLED, also may be used as a means to control the luminance of the display without effecting its contrast ratio.

Unlike current signals used in traditional driver circuits, the RAMP voltage Vr is less sensitive to the process induced variations across the integrated circuit, and therefore it can be uniformly applied to all pixels. By controlling the amplitude of the voltage Vc applied to the capacitor C1 via the DATA input terminal 210, as well as the shape of the amplitude of the RAMP voltage signal Vr, the length of time that the power transistor Q1 is on can be selectively controlled, thereby permitting control over the pixel luminance values (gray scale). If a decrease in luminance is desired, the voltage Vc may be increased during a subsequent update phase. An increase in the voltage Vc results in an increase in the summed voltage Vc+Vr, which in turn causes the power transistor Q1 to turn off earlier in the duty cycle of the RAMP voltage Vr. If an increase in luminance is desired, the voltage Vc may be decreased during the next update phase. The periodically updated voltage Vc applied to each DATA input terminal 210, may differ from pixel to pixel, thereby providing control over luminance on a pixel-by-pixel basis.

Unlike traditional pixel driver circuits, in which the voltage range at the gate of the power transistor Q1 is very small due to the large transconductance of the pmos transistor, the present driver circuit 10 provides an increased dynamic range of voltage (Vc+Vr) at the second node 140, thereby easing design constraints. The increased voltage range at the second node 140 makes the circuit 10 less sensitive to leakage current arising from the reverse p-n junction present at the access transistor Q2 because the minimum voltage level necessary to turn the power transistor Q1 off is greater than in a traditional structure. Thus, a given leakage current across the access transistor Q2 may take longer to effect the level of voltage Vc in a circuit constructed in accordance with the present invention. The increased voltage range at the second node 140 may also enable the use of a smaller storage capacitor C1 than would otherwise be possible because by increasing this voltage level, a smaller capacitor may be used to store a given electrical charge. Smaller capacitors result permit smaller pixels, smaller circuits, and thus lower cost per unit (more dies per wafer).

The driver circuit of the present invention also provides other benefits. By carefully shaping the slope of the RAMP voltage Vr, as well as controlling its amplitude, the time period during which Vr+Vc (the voltage at the second node 140) is close to the threshold voltage Vt of the power transistor Q1 can be minimized, reducing the impact of variability across the integrated circuit. Furthermore, selective shaping of the RAMP voltage Vr may enable the gray scale voltage levels to be linearly divided, further reducing design constraints.

Figure 3:
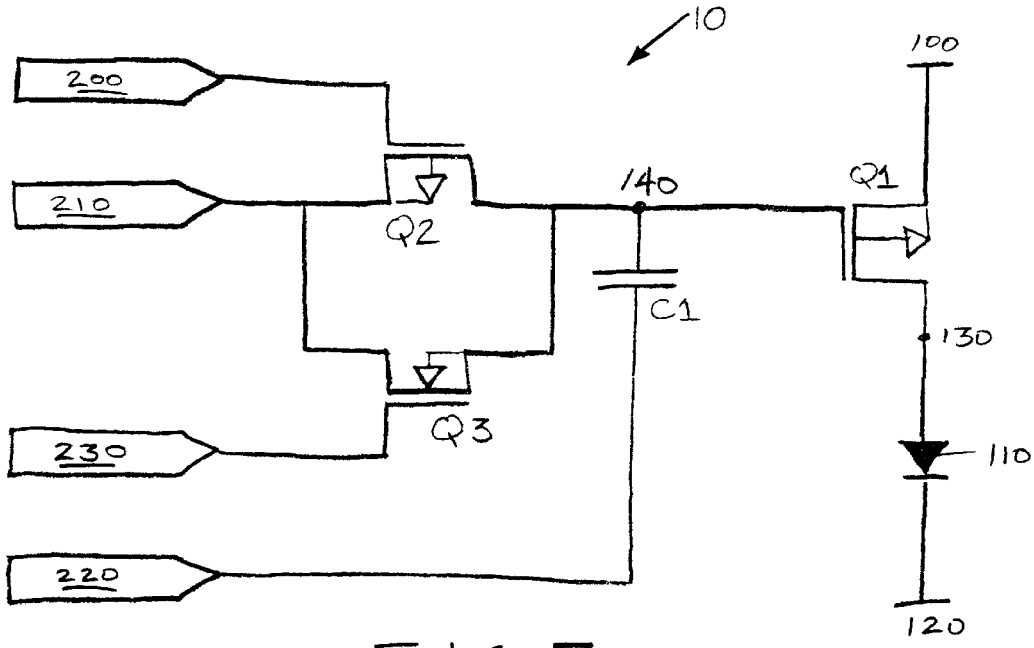
FIG. 3 is a schematic diagram of a pixel driver circuit in accordance with a second embodiment of the invention.

With reference to FIG. 3, in which like reference numerals refer to like elements, in an alternative embodiment of the invention a cmos structure (first and second access transistors Q2 and Q3) can be used to reduce the effect of charge injection in a second embodiment of the invention. The second access transistor Q3 is connected to a −ROW input terminal 230.

Figure 4:
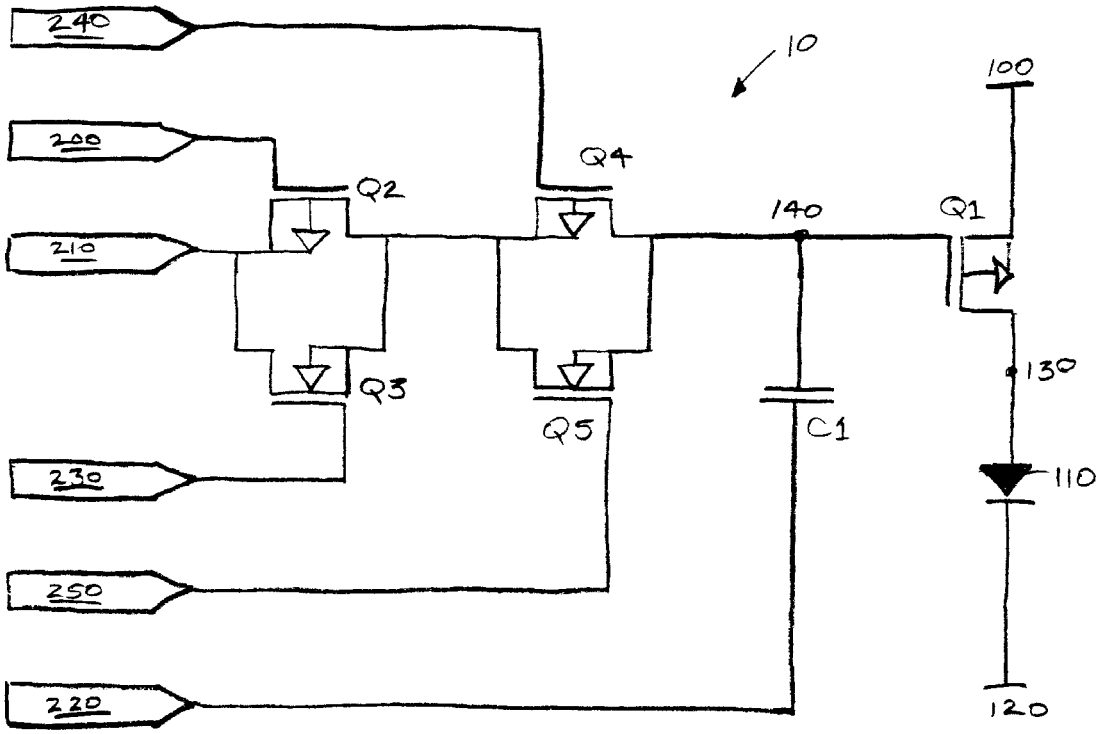
FIG. 4 is a schematic diagram of a pixel driver circuit in accordance with a third embodiment of the invention.

With reference to FIG. 4, in which like reference numerals refer to like elements, in a second alternative embodiment of the invention some display architectures may require a column access switch, comprising single transfer gate or full complementary transfer gate transistors Q4 and Q5, at the pixel itself. The fourth transistor Q4 is connected to a COLUMN input terminal 240, and the fifth transistor Q5 is connected to a −COLUMN input terminal 250.

Figure 5:
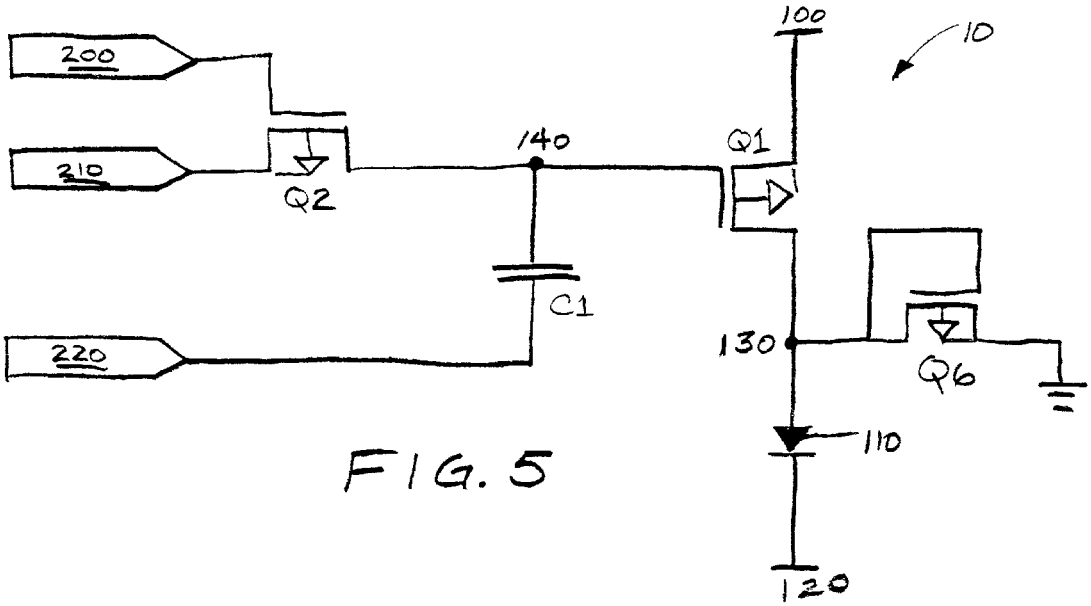
FIG. 5 is a schematic diagram of a pixel driver circuit in accordance with a fourth embodiment of the invention.

With reference to FIG. 5, in which like reference numerals refer to like elements, in a third alternative embodiment of the invention, the voltage level at the cathode terminal 120 may exceed the process breakdown voltage for power transistor Q1. The addition of a pmos transistor Q6 configured as a diode, may protect the power transistor Q1 from such a condition. Furthermore, the transistor Q6 may provide for evaluation of the performance of the OLED device 110 independently of the control circuitry. Connecting only the cathode terminal 120 and the GND terminals to a voltage source is enough to create a current flow through the OLED device 110 without applying power to the integrated circuit 10.

Figure 6:
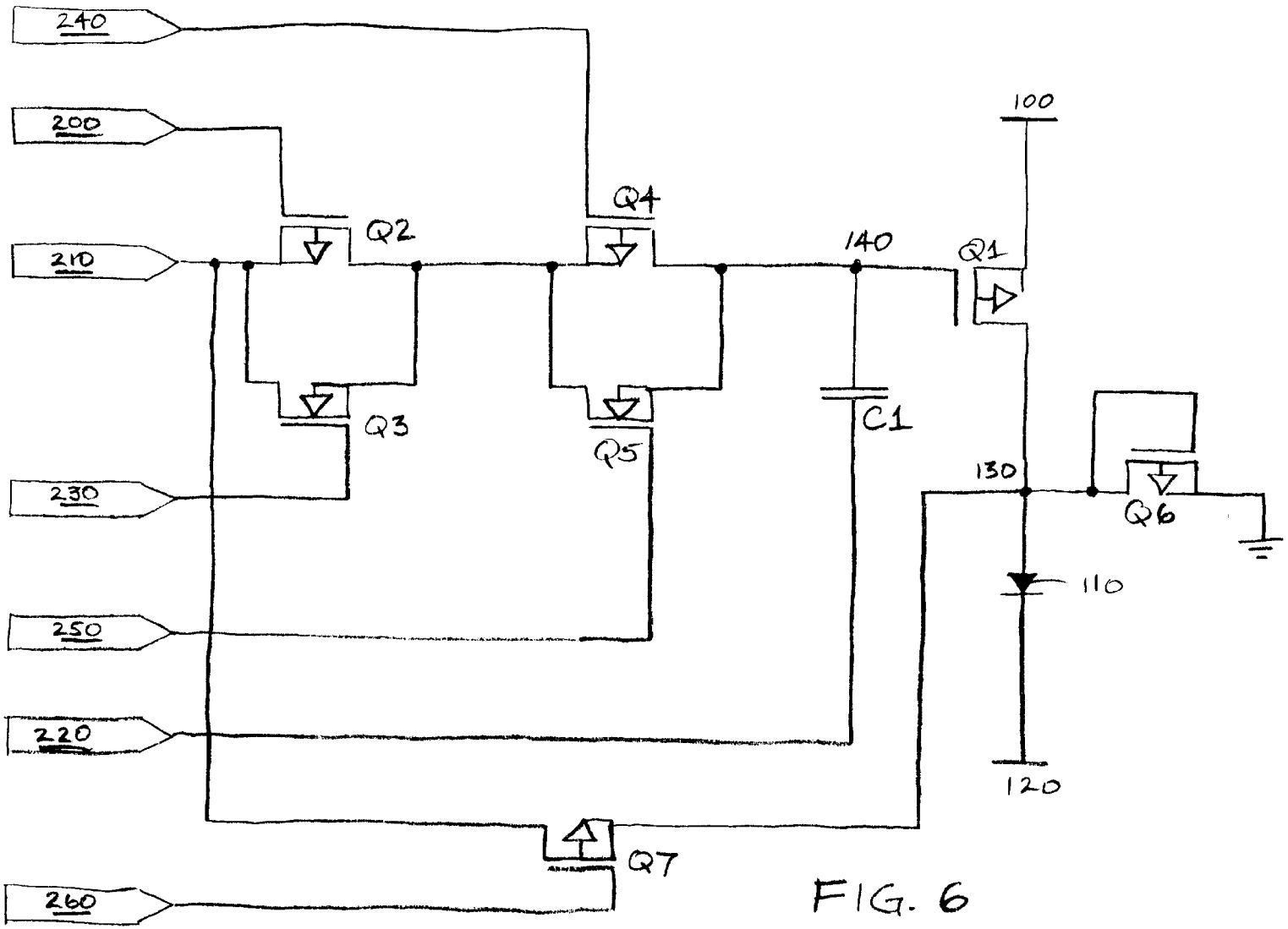
FIG. 6 is a schematic diagram of a pixel driver circuit in accordance with a fifth embodiment of the invention.

With reference to FIG. 6, in which like reference numerals refer to like elements, in a fourth alternative embodiment of the invention, the addition of a test transistor Q7 may improve the ability to test the driver circuit 10 by allowing the power source 100 operation to be verified. The test transistor Q7 connects the power source 100 output back to the DATA input terminal 210. At the end of the DATA input terminal 100, another switch may connect it to a resistor (not shown). The voltage across the resistor can then be read by an internal circuit and converted to a true/false logic level. This level can then be routed to a test output and used by external means to assess the integrated circuit functionality.

We claim:

1. A circuit for driving a light emitting diode in a display using a current supply, said circuit comprising: a first transistor having a source, a drain, and a gate; a current supply connected to the first transistor source; an anode terminal of a light emitting diode connected to the first transistor drain; and a means for applying a combination of at least two voltages to the first transistor gate so as to control the time that the current supply is connected to the light emitting diode, wherein said means for applying comprises: second and third transistors, each having a source, a drain, and a gate; a first voltage source connected to the second transistor gate; a second voltage source connected to the second transistor source and the third transistor drain; a third voltage source connected to the third transistor gate; a capacitor having first and second terminals; a fourth voltage source connected to the first capacitor terminal; and a node connected to the second transistor drain, the third transistor source, the second capacitor terminal, and the first transistor gate.

2. The circuit of claim 1 wherein the second voltage source is adapted to selectively vary output voltage periodically, and the fourth voltage source is adapted to provide a cyclical voltage ramp.

3. The circuit of claim 1 wherein the display comprises a plurality of driving circuits and wherein said fourth voltage source is connected to each of said driving circuits.

4. The circuit of claim 1 wherein the first and second transistors comprise P-type devices, and the third transistor comprises an N-type device.

5. A circuit for driving a light emitting diode in a display using a current supply, said circuit comprising: a first transistor having a source, a drain, and a gate; a current supply connected to the first transistor source; an anode terminal of a light emitting diode connected to the first transistor drain; and a means for applying a combination of at least two voltages to the first transistor gate so as to control the time that the current supply is connected to the light emitting diode, wherein said means for applying comprises: second, third, fourth, and fifth transistors, each having a source, a drain, and a gate; a first voltage source connected to the second transistor gate; a second voltage source connected to the second transistor source and the third transistor drain; a third voltage source connected to the third transistor gate; a fourth voltage source connected to the fourth transistor gate; a fifth voltage source connected to the fifth transistor gate; a first node connected to the second transistor drain, the third transistor source, the fourth transistor source, and the fifth transistor drain; a capacitor having first and second terminals; a sixth voltage source connected to the first capacitor terminal; and a second node connected to the fourth transistor drain, the fifth transistor source, the second capacitor terminal, and the first transistor gate.

6. The circuit of claim 5 wherein the second voltage source is adapted to selectively vary output voltage periodically, and the sixth voltage source is adapted to provide a cyclical voltage ramp.

7. The circuit of claim 5 wherein the display comprises a plurality of driving circuits and wherein said sixth voltage source is connected to each of said driving circuits.

8. The circuit of claim 5 wherein the first, second, and fourth transistors comprise P-type devices, and the third and fifth transistors comprise N-type devices.

9. A circuit for driving a light emitting diode in a display using a current supply, said circuit comprising: a first transistor having a source, a drain, and a gate; a current supply connected to the first transistor source; an anode terminal of a light emitting diode connected to the first transistor drain; and a means for applying a combination of at least two voltages to the first transistor gate so as to control the time that the current supply is connected to the light emitting diode, further comprising: a node coupled to the first transistor drain and the light emitting diode anode terminal; and a test transistor having a drain and a gate connected to said node, and having a source connected to ground.

10. The circuit of claim 9 wherein the means for applying comprises: a data voltage source; a capacitor having first and second terminals; a display row access subcircuit operatively connecting the data voltage source and the capacitor first terminal; and a ramp voltage source operatively connected to the capacitor second terminal.

11. The circuit of claim 10 wherein the display row access subcircuit comprises at least one transistor.

12. A circuit for driving a light emitting diode in a display using a current supply, said circuit comprising: a first transistor having a source, a drain, and a gate; a current supply connected to the first transistor source; an anode terminal of a light emitting diode connected to the first transistor drain; and a means for applying a combination of at least two voltages to the first transistor gate so as to control the time that the current supply is connected to the light emitting diode, wherein said means for applying comprises: second, third, fourth, and fifth transistors, each having a source, a drain, and a gate; a first voltage source connected to the second transistor gate; a second voltage source connected to the second transistor source and the third transistor drain; a third voltage source connected to the third transistor gate; a fourth voltage source connected to the fourth transistor gate; a fifth voltage source connected to the fifth transistor gate; a first node connected to the second transistor drain, the third transistor source, the fourth transistor source, and the fifth transistor drain; a capacitor having first and second terminals; a sixth voltage source connected to the first capacitor terminal; and a second node connected to the fourth transistor drain, the fifth transistor source, the second capacitor terminal, and the first transistor gate, and wherein the circuit further comprises: a third node coupled to the first transistor drain and the light emitting diode anode terminal; a sixth transistor having a drain and a gate connected to said third node, and having a source connected to ground; a seventh voltage source; and a seventh transistor having a source connected to the third node, a drain connected to the second voltage source, and a gate connected to the seventh voltage source.

13. The circuit of claim 12 wherein the second voltage source is adapted to selectively vary output voltage periodically, and the sixth voltage source is adapted to provide a cyclical voltage ramp.

14. The circuit of claim 12 wherein the display comprises a plurality of driving circuits and wherein said sixth voltage source is connected to each of said driving circuits.

15. The circuit of claim 12 wherein the first, second, fourth, sixth, and seventh transistors comprise P-type devices, and the third and fifth transistors comprise N-type devices.

16. A current supply control circuit, comprising: a switch, the switch having a control input, a current source input, and a current supply output, the switch providing current at the current supply output in response to the voltage level at the control input crossing a threshold level; a current supply, the current supply coupled to the current source input of the switch; a first voltage source, the first voltage source being coupled to the control input of the switch, the first voltage source supplying a periodic variable-level voltage signal, the periodic variable-level voltage signal exceeding the threshold level of the switch for a time period; and a second voltage source, the second voltage source being coupled to the control input of the switch, the second voltage source supplying a substantially level voltage signal, the signal provided to the control input of the switch and combined with the voltage signal from the first voltage source, whereby the time period during which the resulting voltage signal exceeds the threshold level of the switch is varied in accordance with the voltage from the second voltage source.

17. The circuit of claim 16, wherein the switch is a transistor having a source, a drain, and a gate.

18. The circuit of claim 16, wherein the current supply control circuit is adapted to couple to the anode of a light emitting diode.

19. The current supply control circuit of claim 16, wherein the first voltage source and the second voltage source are provided to a combination circuit before being provided to the control input.

20. The current supply control circuit of claim 19, wherein the combination circuit comprises: a first transistor having a source, a drain, and a gate, the first transistor drain being connected to the control input of the switch, and the first transistor source being connected to the second voltage source; a third voltage source, the third voltage source being connected to the first transistor gate; and a capacitor, the capacitor having a first terminal and a second terminal, the first capacitor terminal being connected to the control input of the switch, and the second capacitor terminal being connected to the first voltage source.

21. A method for controlling the operation of a current switch wherein the current switch is responsive to a control voltage crossing a threshold level, the method comprising: providing a first voltage signal as the control voltage of the current switch, the first voltage signal exceeding the threshold level of the switch for a first time period; adding a second voltage signal to the first voltage signal, whereby the resultant voltage signal is offset from the first voltage signal; and providing the resultant voltage signal as the control voltage of the current switch, whereby the resultant voltage exceeds the threshold level of the switch for a second time period, whereby the difference between the first time period and the second time period is dependent on the second voltage signal.

22. The method of claim 21, wherein the current switch is a transistor.

23. The method of claim 22, wherein the control voltage is the gate voltage of the transistor.

24. The method of claim 21, wherein the first voltage signal is a ramp signal.

25. The method of claim 21, wherein the second voltage signal is a level voltage signal.

26. The method of claim 25, wherein the memory module is a capacitor.

27. The method of claim 21, further comprising providing the second voltage signal to a memory module and adding the first voltage to the memory module.

* * * * *